US007282125B2

(12) United States Patent
Rupp

(10) Patent No.: US 7,282,125 B2
(45) Date of Patent: Oct. 16, 2007

(54) CONTACT ELEMENT HOLDER

(75) Inventor: Bernhard Rupp, Sulzfeld (DE)

(73) Assignee: Robert Bosch GmbH, Stuttgart (DE)

( * ) Notice: Subject to any disclaimer, the term of this patent is extended or adjusted under 35 U.S.C. 154(b) by 301 days.

(21) Appl. No.: 10/514,819

(22) PCT Filed: May 26, 2003

(86) PCT No.: PCT/DE03/01715

§ 371 (c)(1),
(2), (4) Date: Nov. 17, 2004

(87) PCT Pub. No.: WO2004/040715

PCT Pub. Date: May 13, 2004

(65) Prior Publication Data

US 2005/0205420 A1 Sep. 22, 2005

(30) Foreign Application Priority Data

Oct. 22, 2002 (DE) ..... 102 49 157

(51) Int. Cl.
*C25B 9/02* (2006.01)

(52) U.S. Cl. ..... 204/279; 310/239; 310/237; 310/51; 310/71

(58) Field of Classification Search ..... 204/279; 310/239, 237, 51, 71
See application file for complete search history.

(56) References Cited

U.S. PATENT DOCUMENTS

| | | | | |
|---|---|---|---|---|
| 5,939,812 | A * | 8/1999 | Wetzel | 310/245 |
| 2003/0006660 | A1* | 1/2003 | Kehrer et al. | 310/90 |
| 2003/0117035 | A1* | 6/2003 | Gerstenberger | 310/239 |

FOREIGN PATENT DOCUMENTS

DE 4241405 * 6/1994

* cited by examiner

*Primary Examiner*—Bruce F. Bell
(74) *Attorney, Agent, or Firm*—Ronald E. Greigg

(57) ABSTRACT

A contact element holder, in particular a brush holder for commutator or wiper ring machines, has a carrier that can be secured to the machine housing and at least one quiver, held on the carrier and pointing toward the rotor, for displaceably receiving a contact element, and also has decoupling elements which are disposed between the carrier and the quiver. To achieve good noise decoupling of the contact element from the machine housing and, in use in a commutator machine, for assuring good commutation quality, the decoupling elements are embodied and disposed such that the at least one quiver is capable of executing only a limited rotational pivoting distance about the rotor.

20 Claims, 1 Drawing Sheet

CONTACT ELEMENT HOLDER

CROSS-REFERENCE TO RELATED APPLICATIONS

This application is a 35 USC 371 application of PCT/DE03/01715 filed on May 26, 2003.

BACKGROUND OF THE INVENTION

1. Field of the Invention

The invention is directed to an improved contact element holder for electrically contacting a rotor, and in particular on an improved brush holder for commutator or wiper ring machines.

2. Description of the Prior Art

Because of commutator nonconcentricities, commutator brushes of commutator machines, such as direct current small motors, cause abrupt changes at the transition from one commutator lamination to another, and similar noises that are transmitted via the brush carrier to the machine housing and are radiated from there. To reduce these running noises, noise-decoupled brush holders are used.

To assure good-quality commutation, it is important that the brush holder be located centrally to the commutator axis. Deviations from that cause asymmetries in the supply of electrical current, and the resultant forces are in turn the cause of noises. In the noise-decoupled brush holder, a certain flexibility of the brush quivers relative to the brush carrier must be accepted, and hence the inaccuracy, linked with this flexibility, of the central position of the commutator brushes makes the quality of commutation worse.

In a known noise-decoupled brush holder (German Patent Disclosure DE 42 41 405 A1), the decoupling elements between the carrier and the brush quiver are embodied as spring-elastic ribs, which connect an intermediate carrier, which firmly receives the brush quivers, to the carrier. Both the intermediate carrier and the carrier are embodied as plates that are located in the same plane. The ribs, embodied in meandering form, are either located in the plane of the plates or extend perpendicular to the plates; in the latter case, the meandering pattern points in the axial direction of the commutator. The two plates and the ribs are embodied as an integral injection-molded part.

SUMMARY AND ADVANTAGES OF THE INVENTION

The contact element holder of the invention has the advantage that a rotary decoupling of the quivers about the rotor axis is attained without additional degrees of freedom of a translational or rotational type, and as a result, in use in commutator machines, the centered position of the commutator brushes required for good commutation is no worse than in a non-noise-decoupled, rigid brush holder. The fluctuations in frictional values, responsible for brush noise, between commutator laminations and commutator brushes cause only a rotational motion of the quivers and hence do not affect the centered position of the commutator brushes. By varying the geometry, position and number of the decoupling elements, the contact element holder can be adapted in a targeted way and can thus be adapted quite simply to different kinds of applications or machines.

Structurally, the contact element holder of the invention can be realized quite simply by providing that in a preferred embodiment of the invention, at least three decoupling elements are provided, and each decoupling element has only one degree of freedom, and the decoupling elements are disposed between the carrier and the at least one quiver such that the degree of freedom of each decoupling element extends in the tangential direction to the rotor.

In a preferred embodiment of the invention, the decoupling elements are disposed offset from one another in the circumferential direction by preferably the same rotational angle, or in other words are disposed in a star pattern.

In a preferred embodiment of the invention, the quivers are disposed on an intermediate carrier, and the carrier and the intermediate carrier are joined together by the decoupling elements; preferably, the decoupling elements are embodied as elastic, shallow ribs, each of which is located in a plane that is radial to the rotor axis. The carrier and the intermediate carrier are embodied as plates of insulating material which are located in the same plane, and the elastic ribs extend perpendicular to the plates. As a result of this structural embodiment with "upright decoupling elements", the contact element holder requires little space, which is advantageous for accommodating additional interference suppression elements. Moreover, in the injection molding of the integral contact element holder, the decoupling elements are located in the unmolding direction, so that no additional transverse pushers in the injection-molding tool are required.

BRIEF DESCRIPTION OF THE DRAWINGS

The invention is described in further detail below, with reference to the drawings, in which.

DESCRIPTION OF THE PREFERRED EMBODIMENTS

Figure 1:
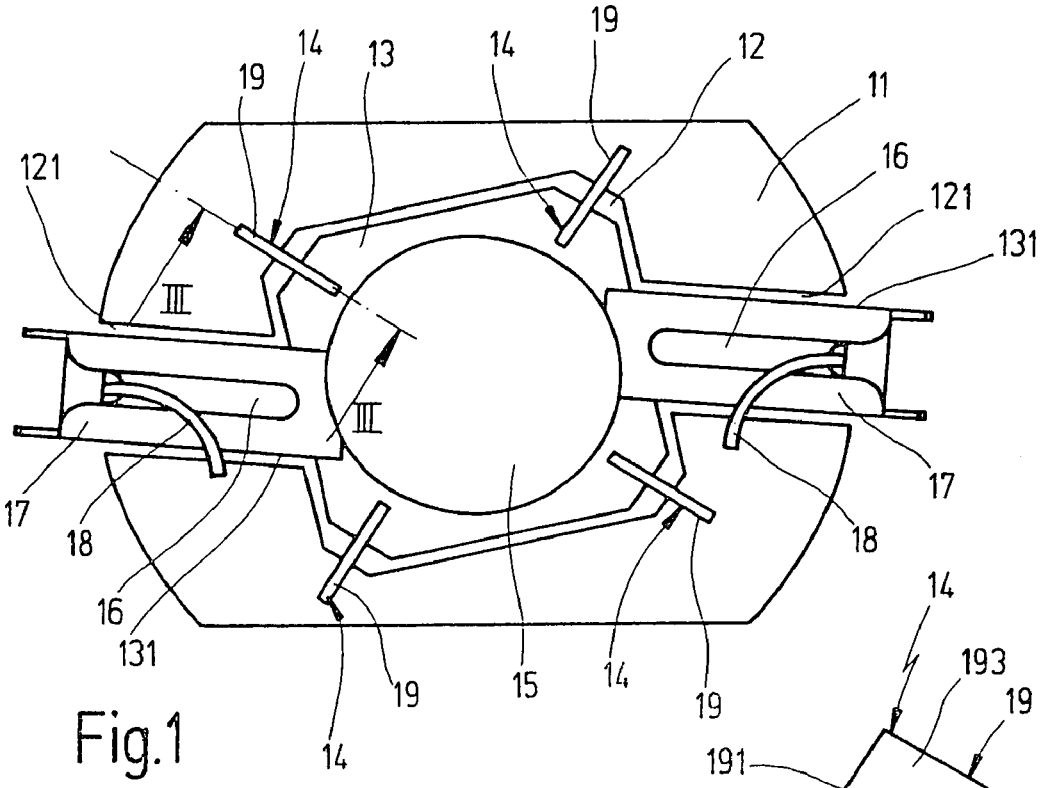
FIG. 1 is a plan view of a brush holder for a small direct current motor, in a first exemplary embodiment.

The brush holder, shown in plan view in FIG. 1, for a commutator machine used as a small direct current motor, as an example of a contact element holder, has a carrier 11, in the middle of which is a substantially square recess 12 in which an intermediate carrier 13 is located. The carrier 11 and the intermediate carrier 13 are embodied as disklike plates of insulating material and are joined together via a total of four elastic decoupling elements 14. The intermediate carrier 13 has a circular through opening 15 for the passage through it of a commutator, not shown here, of the small DC motor.

For the small DC motor, embodied with two poles, the brush holder has two commutator brushes 16, which are each axially displaceably received in a brush quiver 17 that extends in the direction of the through opening 15 and which are pressed against the commutator, in the installed state, by means of brush pressing springs, not shown here. The electrical connection cords of the commutator brushes 16 are identified by reference numeral 18. The brush quivers 17 are secured to the intermediate carrier 13. To that end, two projecting arms 131 are provided on the intermediate carrier 13 and rest with play in corresponding lateral elongations 121 of the recess 12. The brush quivers 17 are made of metal and are secured to the arms 131. In an alternative embodiment of the invention, the brush quivers 17 may be made of insulating material, and in that case they are produced integrally with the plate of insulating material of the intermediate carrier 13 by injection molding, so that the arms 131 are omitted.

The four decoupling elements 14 are disposed in a star pattern, offset from one another by the same circumferential angles, about the through opening 12 in the intermediate carrier 13 and are fixed on one end between the brush quivers 17 on the intermediate carrier 13 and on the other on the carrier 11. Each decoupling element 14 has only one degree of freedom and is disposed such that this degree of freedom extends in the tangential direction to the commutator, or in other words to the through opening 15 that receives the commutator; it is understood that the brush holder is mounted in the motor housing in such a way that the axis of the through opening 15 in the intermediate carrier 13 coincides with the commutator axis. Because of the star-pattern arrangement of the decoupling elements 14 with a tangentially oriented degree of freedom, the intermediate carrier 13, with the brush quivers 17 secured to it, can execute only a limited, rotational pivoting movement about the commutator, so that the commutator brushes 16 that press against the commutator are rotationally decoupled. Either no additional degrees of freedom, namely two rotational degrees of freedom and three translational degrees of freedom, exist, or they are negligible.

Figure 3:
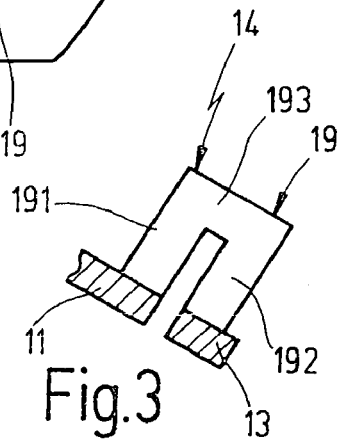
FIG. 3, a section taken along the line III-III in FIG. 1.

In the exemplary embodiment of FIG. 1, the decoupling elements 14 are realized by means of elastic, shallow ribs 19, each of which is located in a plane radial to the commutator axis or to the axis of the through opening 15. In the sectional view in FIG. 3, one such shallow rib can be seen in plan view. It has the shape of a U, with legs 191, 192 and a yoke 193 that connects the legs 191, 192. One leg 191 is secured to the carrier 11, and the other leg 192 is secured to the intermediate carrier 13. Preferably, the ribs 19 are integrally injection-molded to the carrier 11 and intermediate carrier 13 in the injection molding of those elements, and simultaneously the brush quivers 17 are integrally injection-molded, so that the separate arms 131 on the intermediate carrier 13 are omitted. The ribs 19 protrude at a right angle from plates of insulating material that form the carrier 11 and the intermediate carrier 13, so that in the injection molding process, the ribs are located in the unmolding direction, and no additional transverse pushers in the injection-molding tool are necessary.

Figure 2:
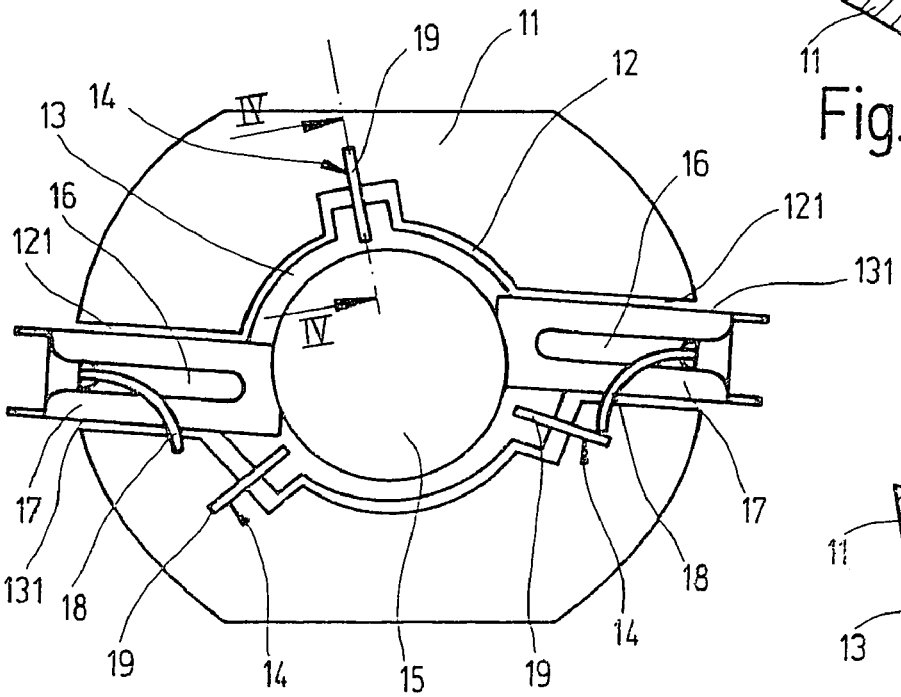
FIG. 2 is a view similar to FIG. 1 showing a second exemplary embodiment.
Figure 4:
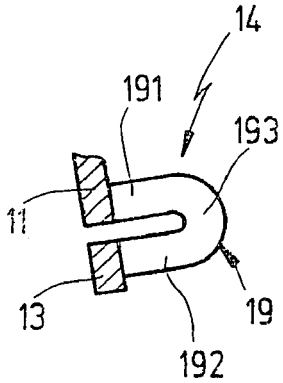
FIG. 4, a section taken along the line IV-IV in FIG. 2.

The brush holder that can be seen in plan view in FIG. 2, in accordance with a further exemplary embodiment, is conceived of on the same fundamental principle. Once again, the decoupling elements have only one degree of freedom and are disposed between the carrier 11 and the intermediate carrier 13 in such a way that the existing degree of freedom extends in the tangential direction to the commutator, so that the brush quivers 17, with the commutator brushes located in them, are capable of executing only a limited rotation about the commutator, and all the other degrees of freedom of the intermediate carrier 13 are practically not present. Unlike the brush holder of FIG. 1, here the intermediate carrier 13 is embodied as a circular plate of insulating material, which rests with play in the likewise circular recess 12 of the carrier 11 also embodied as an plate of insulating material. The number of decoupling elements that join the carrier 11 and the intermediate carrier 13 is reduced to the minimum number of three decoupling elements 14. These are again arranged in a star pattern relative to the commutator axis, that is, the axis of the through opening 15 for the commutator, and are each located in a plane that is radial to the commutator axis or to the axis of the through opening 15. As FIG. 4 shows, each decoupling element 14 is again embodied as a shallow elastic rib 19 which is U-shaped and protrudes at a right angle from plates of insulating material that form the carrier 11 and the intermediate carrier 13. In the same way as in FIGS. 1 and 3, the rib 19 here is again solidly joined by one leg 191 to the carrier and by its other leg 192 to the intermediate carrier 13. The yoke 193 is embodied in curved form, unlike FIG. 3. Otherwise, the construction and mode of operation of the modified brush holder of FIG. 2 are identical to those of the brush holder in FIG. 1, so that reference may be made in this respect to the above description. Components of the brush holder of FIG. 2 that match the components of the brush holder in FIG. 1 are identified by the same reference numerals.

The contact element holder, described as an example as a brush holder for a commutator machine, for producing an electrical connection with a rotor, in this exemplary embodiment with the commutator, can also be used in so-called wiper ring machines, such as synchronous machines with a wiper ring rotor. In that case, instead of the commutator brushes, so-called grinding brushes are inserted into the quivers and rest in spring-loaded fashion on at least one wiper ring, instead of a commutator. Moreover, the contact element holder described may be used wherever an electrical touch contact is to be made between a three-dimensionally stationary current-carrying component and a current-carrying component (rotor) that rotates relative to it.

The foregoing relates to preferred exemplary embodiments of the invention, it being understood that other variants and embodiments thereof are possible within the spirit and scope of the invention, the latter being defined by the appended claims.

The invention claimed is:

1. A holder for electrically contacting a rotor of a commutator or wiper ring machine, the holder comprising, a fixed carrier (11), at least one quiver (17) supported on the carrier (11) and pointing toward a central through opening (15) for the rotor, for displaceably receiving an electrically conductive contact element (16), and decoupling elements (14) for supporting the at least one quiver (17) on the fixed carrier (11) such that the at least one quiver (17) is capable of executing only a limited rotational pivoting movement about the rotor.

2. The holder of claim 1 comprising at least three said decoupling elements (14), each decoupling element (14) having only one degree of freedom, the decoupling elements (14) supporting the at least one quiver (17) on the fixed carrier (11) such that the degree of freedom extends in the tangential direction to the rotor.

3. The holder of claim 2, wherein the decoupling elements (14) are disposed offset from one another in the circumferential direction by preferably the same rotational angle.

4. The holder of claim 3, wherein the decoupling elements (14) are embodied as elastic, shallow ribs (19), each of which is located in a plane that is radial to the axis of the central through opening (15) for the rotor.

5. The holder of claim 2, further comprising an intermediate carrier, the at least one quiver (17) being disposed on the intermediate carrier (13) and the decoupling elements (14) joining the carrier (11) and the intermediate carrier (13) together.

6. The holder of claim 2, wherein the decoupling elements (14) are embodied as elastic, shallow ribs (19), each of which is located in a plane that is radial to the axis of the central through opening (15) for the rotor.

7. The holder of claim 1, wherein the decoupling elements (14) are disposed offset from one another in the circumferential direction by preferably the same rotational angle.

8. The holder of claim 7, further comprising an intermediate carrier, the at least one quiver (17) being disposed on the intermediate carrier (13) and the decoupling elements (14) joining the carrier (11) and the intermediate carrier (13) together.

9. The holder of claim 7, wherein the decoupling elements (14) are embodied as elastic, shallow ribs (19), each of which is located in a plane that is radial to the axis of the central through opening (15) for the rotor.

10. The holder of claim 1, further comprising an intermediate carrier, the at least one quiver (17) being disposed on the intermediate carrier (13) and the decoupling elements (14) joining the carrier (11) and the intermediate carrier (13) together.

11. The holder of claim 10, wherein the decoupling elements (14) engage the intermediate carrier (13) with spacing from the at least one quiver (17).

12. The holder of claim 10, wherein the decoupling elements (14) are embodied as elastic, shallow ribs (19), each of which is located in a plane that is radial to the axis of the central through opening (15) for the rotor.

13. The holder of claim 12, wherein each rib (19) is embodied as U-shaped, with two legs (191, 192) and a yoke (193) joining the legs (191, 192), located in the radial plane; and wherein one leg (191) of each rib is secured to the carrier (11), and the other leg (192) is secured to the intermediate carrier (13).

14. The holder of claim 13, wherein the carrier (11) and intermediate carrier (13) are embodied as plates of insulating material, and wherein ribs (19) protrude at a substantially right angle from the plates of insulating material.

15. The holder of claim 14, further comprising at least one quiver (17) secured to the plate of insulating material forming the intermediate carrier and is preferably of metal.

16. The holder of claim 14, wherein the at least one quiver (17) is embodied integrally with the plate of insulating material that forms the intermediate carrier (13).

17. The holder of claim 16, comprising at least two quivers (17) offset from one another by the same rotational angle are present.

18. The holder of claim 14, wherein the plates of insulating material, which form the carrier (11) and the intermediate carrier (13), and the ribs (19) are integrally injection-molded.

19. The holder of claim 1, wherein the decoupling elements (14) are embodied as elastic, shallow ribs (19), each of which is located in a plane that is radial to the axis of the central through opening (15) for the rotor.

20. The holder of claim 1, comprising at least two quivers (17) offset from one another by the same rotational angle are present.

* * * * *